US006155608A

United States Patent [19]

Skinner et al.

[11] Patent Number: 6,155,608

[45] Date of Patent: Dec. 5, 2000

[54] SELF-LOCKING CONNECTOR

[75] Inventors: Neal G. Skinner, Lewisville; Don L. Weeks, Lake Dallas, both of Tex.

[73] Assignee: Halliburton Energy Services, Inc., Dallas, Tex.

[21] Appl. No.: 09/377,462

[22] Filed: Aug. 19, 1999

Related U.S. Application Data

[62] Division of application No. 09/037,592, Mar. 9, 1998.

[51] Int. Cl.[7] ..... F16L 39/00

[52] U.S. Cl. ..... 285/125.1; 285/93; 285/179; 285/351

[58] Field of Search ..... 285/179, 19, 351, 285/181, 125.1, 93

[56] References Cited

U.S. PATENT DOCUMENTS

| | | | |
|---|---|---|---|
| 2,481,404 | 9/1949 | Donner | 285/179 X |
| 3,930,674 | 1/1976 | Jonsson | 285/179 X |
| 4,239,262 | 12/1980 | Krupp et al. | 285/179 X |
| 4,288,103 | 9/1981 | Gallaghher | 285/179 X |
| 5,443,580 | 8/1995 | Cotter | 285/179 |

*Primary Examiner*—Dave W. Arola

*Attorney, Agent, or Firm*—Paul I. Herman; Lawrence R. Youst

[57] ABSTRACT

An apparatus and method for sampling downhole fluids comprising a tool (36) attached to a connector (34) that is locked into position within a pipe section (32) is disclosed. The pipe section (32) has a longitudinal slot (62) with first and second sides (78, 80). The pipe section (32) also includes a transverse slot (64) that extends perpendicularly from the first side (78) of the longitudinal slot (62) and a hole (66) that extends perpendicularly from the second side (80) of the longitudinal slot (62). The connector (34) is inserted into the hole (66) such that the connector (34) may be rotated between an insertion position and an operating position. The connector head (100) of the connector (34) is closely received within the longitudinal slot (62) such that when the connector (34) is in the operating position, the connector head (100) contacts the first side (78) of the longitudinal slot (62) to lock the connector (34) within the pipe section (32).

15 Claims, 5 Drawing Sheets

SELF-LOCKING CONNECTOR

This application is a division of Ser. No. 09/037,592 filed Mar. 9, 1998.

TECHNICAL FIELD OF THE INVENTION

This invention relates, in general, to a connector for tapping into a pipe and, in particular, to a self-locking, leak resistant connector for attaching a downhole tool to the pipe.

BACKGROUND OF THE INVENTION

Without limiting the scope of the invention, its background is described in connection with downhole pressure sensing, as an example.

In the process of drilling, testing, completing or producing an oil and gas well, it is often useful to be able to measure the pressure at various locations of the well. For example, of particular interest is the pressure in the various production zones that are traversed by the well. Typically, this may be achieved by including a pressure transducer as a portion of a test string included in the pipe string.

Alternatively, attempts have been made to place a pressure transducer on the outside diameter of the tubing or pipe string. Attaching the pressure transducer to the outside of the pipe string typically utilizes a threaded engagement usually included some form of tapered pipe thread, such as a National Pipe Threads (NPT). Although these types of threads are often used in such applications, it has been found that the pressure differential across the threads in testing or other well operations often exceed the specified pressure rating of the threads which has resulted in inaccurate pressure readings due to leakage. Additionally, it has been found that using threaded connections often makes installation of the pressure transducer on the outside of the pipe string difficult.

A need has, therefore, arisen for an apparatus for obtaining downhole pressure readings from the outside of a pipe string that does not rely on a metal to metal seal to prevent leakage. A need has also arisen for such an apparatus that is simple and quick to install. Further, a need has arisen for such an apparatus that may obtain pressure reading from both inside and outside of the pipe string and that may be locked in place following installation in order to withstand the hostile downhole environment.

SUMMARY OF THE INVENTION

The present invention disclosed herein comprises an apparatus and method for connecting a downhole tool to the outside of a pipe string that does not rely on a metal to metal seal to prevent leakage. The apparatus is simple and quick to install and may provide a path for fluid communication from both inside and outside of the pipe string to obtain pressure, temperature or fluid composition data and the like. The apparatus is self-locking with the pipe string and is thereby able to withstand the hostile downhole environment.

The present invention comprises a connector that includes a connector head and a first coupling extending from the connector head in a first direction. The connector also includes a second coupling extending from the connector head in a second direction perpendicular to the first direction that receives a downhole tool thereon. The connector head has a first dimension corresponding to the length of the connector head parallel to the axis of the second coupling. The connector head has a second dimension corresponding to the length of the connector head perpendicular to the axis of the first coupling and perpendicular to the axis of the second coupling. The length of the first dimension is larger than the length of the second dimension such that the connector is self-locking within a pipe section of the present invention. The pipe section of the present invention has a longitudinal slot with first and second sides. A transverse slot extends perpendicularly from the first side of the longitudinal slot and a hole extending perpendicularly from the second side of the longitudinal slot.

The first coupling of the connector is insertable into the hole such that the connector may be rotated between an insertion position and an operating position. Once the first coupling is fully inserted into the hole and the connector head is aligned with the longitudinal slot of the pipe section, the connector may be rotated from the insertion position to the operating position. The connector head is closely received within the longitudinal slot such that when the connector is in the operating position, the connector head contacts the first side of the longitudinal slot, thereby locking the first coupling within the hole and locking the connector within the pipe section.

The first coupling of the connector may include a flange and a radially reduced area. An annular seal may be disposed about the radially reduced area to provide a seal between the first coupling and the hole. Similarly, the second coupling of the connector may include a flange and a pair of radially reduced areas having a separator flange therebetween. A pair of annular seals may be disposed respectively about the pair of radially reduced areas to provide a seal between the second coupling and the pressure transducer.

In one embodiment of the present invention, the pipe section includes a port that provides fluid communication between the hole and the interior of the pipe section and the connector includes a fluid passageway that provides fluid communication through the first coupling, the connector head and the second coupling. In this embodiment, a pressure transducer attached to the second coupling may obtain pressure readings from the interior of the pipe section.

In another embodiment of the present invention, the connector includes a fluid passageway extending through a portion of the second coupling and at least one port providing fluid communication between the fluid passageway and the outside of the second coupling. In this embodiment, a pressure transducer attached to the second coupling may obtain pressure readings from the exterior of the pipe section.

In the method of the present invention, the connector has a downhole tool coupled thereto and is received within the pipe section such that the connector head may slide within the transverse slot of the pipe section. The first coupling is then inserted into the hole of the pipe section and the connector is rotated between the insertion position and the operating position such that connector head is closely received within the longitudinal slot. Upon rotation, the connector is locked in place within the pipe section. The pipe section, including the connector and the downhole tool is then disposed downhole.

BRIEF DESCRIPTION OF THE DRAWINGS

For a complete understanding of the present invention, including its features and advantages, reference is now made to the detailed description of the invention taken in conjunction with the accompanying drawings in which like numerals identify like parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
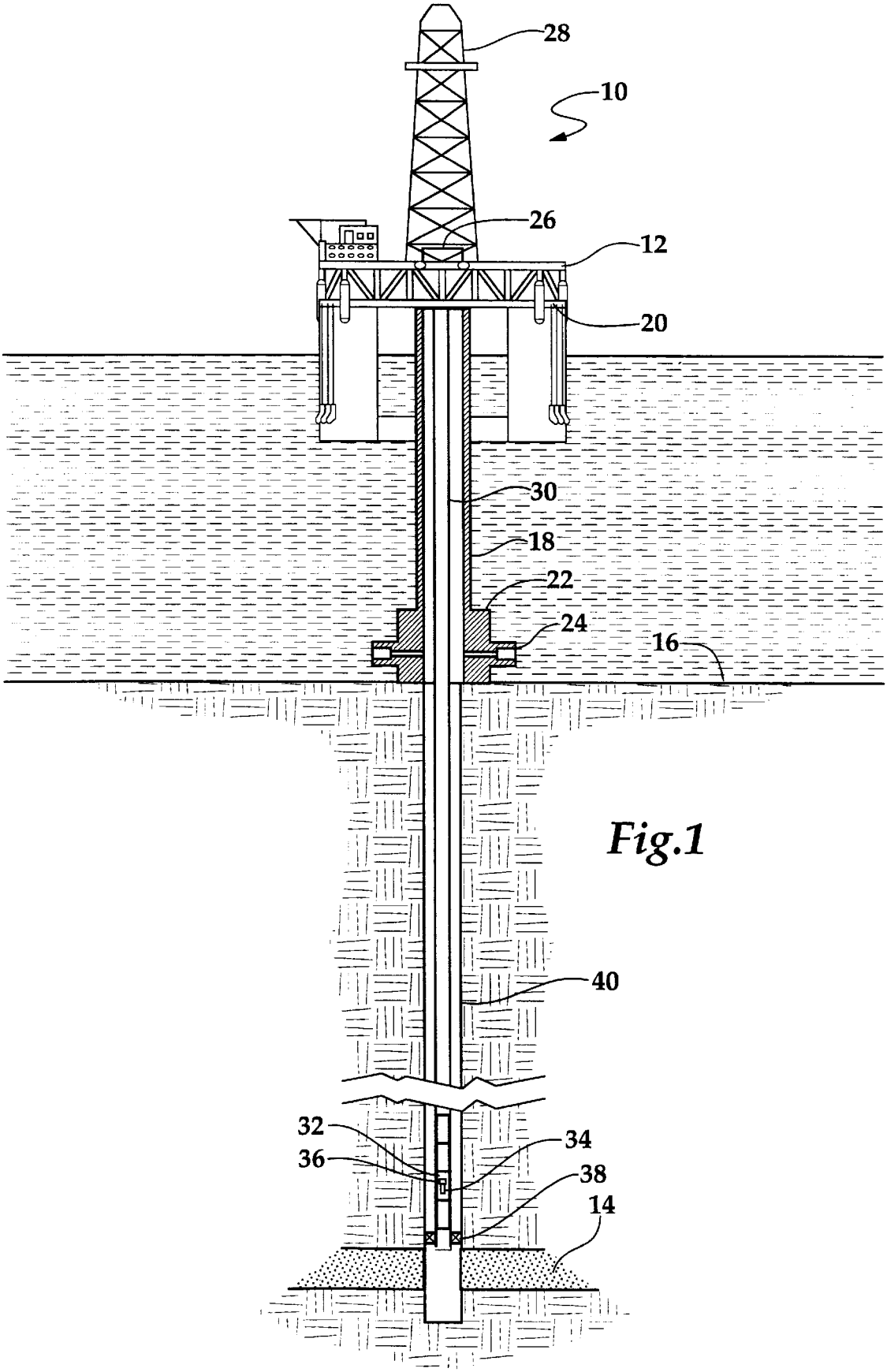
FIG. 1 is a schematic illustration of an offshore oil and gas platform operating a connector of the present invention.

Referring to FIG. 1, a connector in use during an offshore testing operation is schematically illustrated and generally designated 10. Semisubmersible platform 12 is centered over a submerged oil and gas formation 14 located below sea floor 16. Subsea conduit 18 extends from deck 20 of platform 12 to a wellhead installation 22 including blowout preventors 24. Platform 12 has hoisting apparatus 26 and a derrick 28 for raising and lowering pipe string 30 including pipe section 32 that receives connector 34 and pressure transducer 36. Using pipe section 32, connector 34 and pressure transducer 36, pressure reading may be obtained from within pipe string 30. Alternatively, if seal assembly 38 is operated to seal between pipe string 30 and wellbore 40, pressure reading may be obtained from either within pipe string 30 or from the annulus between pipe string 30 and wellbore 40 depending upon the configuration of connector 34.

Even though pipe section 32, connector 34 and pressure transducer 36 have been depicted during a well testing operation, it should be understood by one skilled in the art that pipe section 32 and connector 34 of the present invention in conjunction with pressure transducer 36 are equally well-suited for use during all phases of the life of wellbore 40 including, but not limited to, drilling, completing and producing the well.

Even though connector 34 has been use to connect pressure transducer 36 to pipe section 32, it should be understood by one skilled in the art that a variety of other tools may be connected to pipe section 32 by connector 34. For example, tools such as a temperature transducer, a fluid sampling device and the like may alternatively be attached to pipe section 32 by connector 34 of the present invention.

Figure 2:
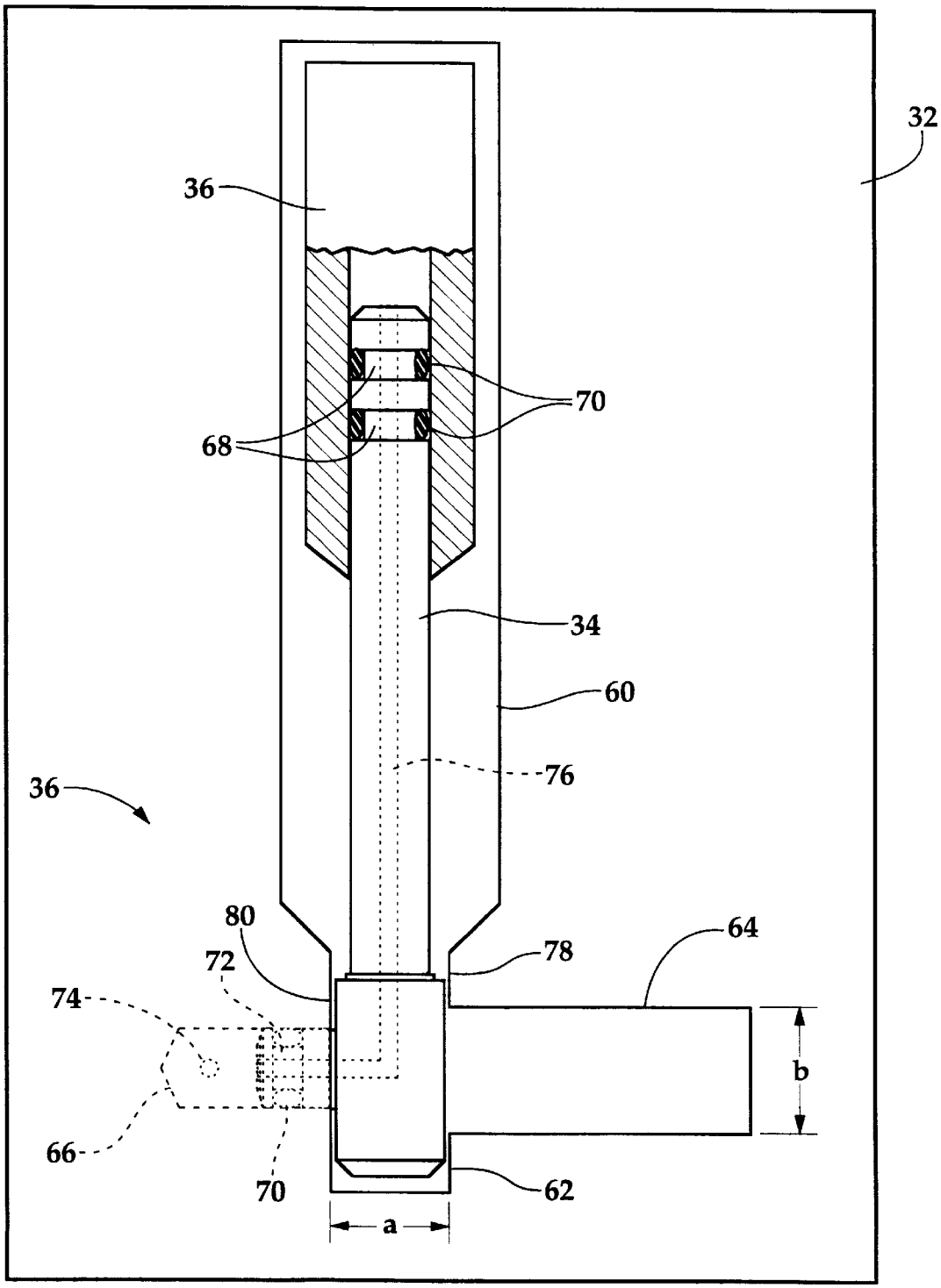
FIG. 2 is an enlarged view of a connector of the present invention attached to a pipe section.

Referring to FIG. 2, an enlarged view of pipe section 32 is depicted. Pipe section 32 includes a wide longitudinal slot 60 and a narrow longitudinal slot 62 having sides 78, 80. Extending perpendicularly from side 78 of narrow longitudinal slot 62 is a transverse slot 64. Extending perpendicularly from side 80 of narrow longitudinal slot 62 is a hole 66. This combination of slots 60, 62, 64 and hole 66 receives and retains connector 34 and pressure transducer 36.

Narrow longitudinal slot 62 has a dimension, a, that represents the width of narrow longitudinal slot 62. As will be more fully discussed below, narrow longitudinal slot 62 closely receives connector 34 between sides 78, 80 to prevent relative transverse movement between pipe section 32 and connector 34 once connector 34 is installed. Transverse slot 64 has a dimension, b, that represents the width of transverse slot 64. In conjunction with narrow longitudinal slot 62, transverse slot 64 prevents relative transverse movement between connector 34 and pipe section 32, as will be more fully discussed below.

Connector 34 includes a pair of radially reduced areas 68 around which annular seals 70 may be placed. Annular seals 70 create a sealing engagement between connector 34 and pressure transducer 36 such that accurate pressure readings may be obtained. Connector 34 also has a radially reduced area 72 around which an annular seal 70 is placed such that a sealing engagement is created between connector 34 and hole 66.

Pipe section 32 includes a port 74 that provides a path for fluid communication between the interior of pipe section 32 and hole 66. Fluid passageway 76 of connector 34 provides a path for fluid communication through connector 34 between hole 66 and pressure transducer 36. Pressure readings from inside pipe section 32 are thereby obtained utilizing port 74 and fluid passageway 76 to transmit fluid pressure between the interior of pipe section 72 and pressure transducer 36.

Even though FIG. 2 has depicted connector 34 in a vertical orientation, it should be noted by those of ordinary skill in the art that connector 34 may be oriented in any position. For example, connector 34 is equally well-suited for use in a deviated or horizontal well.

Figure 3C:
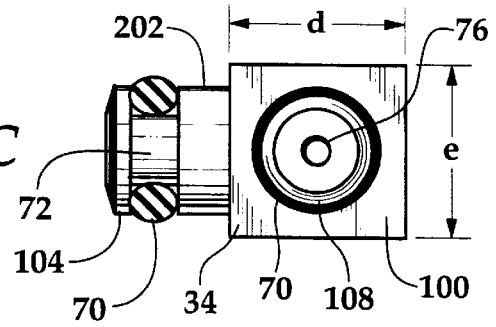
FIGS. 3A–3C are respectively side, front and top elevation views of a connector of the present invention.
Figure 3B:
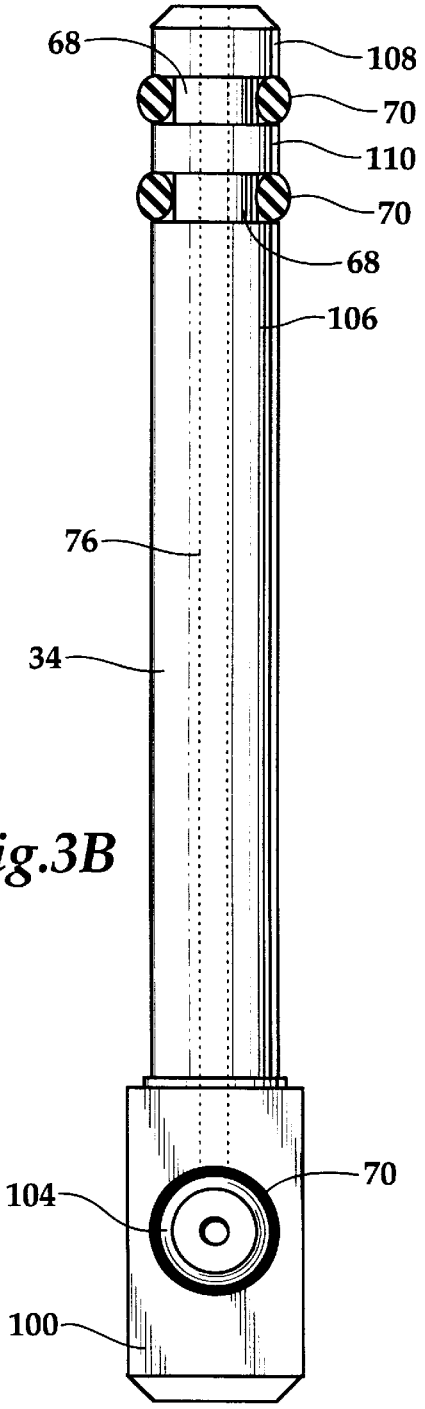
Figure 3A:
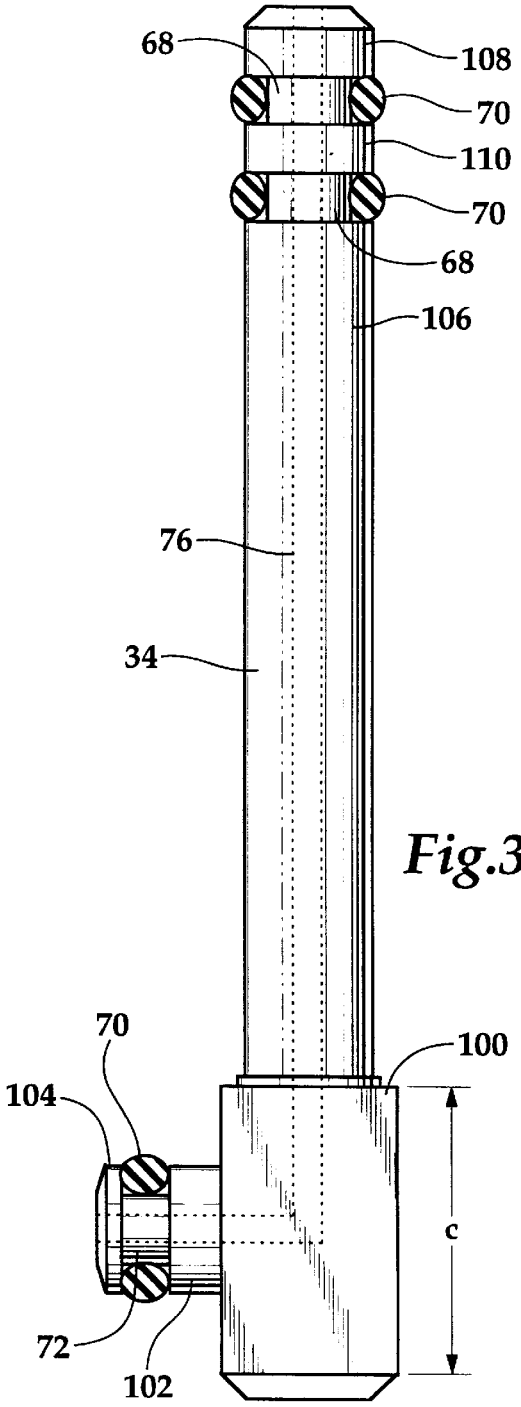

Referring now to FIGS. 3A–3C, connector 34 is depicted in side, front and top elevation views. Connector 34 has a connector head 100. Extending outwardly from connector head 100 is pipe coupling 102. Pipe coupling 102 has an outer flange 104 and a radially reduced area 72 for receiving and retaining an annular seal 70 such that when connector 34 is coupled with pipe section 32, as depicted in FIG. 2, a sealing engagement is created between pipe coupling 102 and hole 66 of pipe section 32. Extending outwardly from connector head 100 at a ninety degree angle from pipe coupling 102 is transducer coupling 106. Transducer coupling 106 has an outer flange 108, a separator flange 110 and a pair of radially reduced areas 68. Radially reduced areas 68 receive and retain annular seals 70. Separator flange 110 maintains a spaced apart relationship between the annular seals 70. Annular seals 70 create a sealing engagement between transducer coupling 106 and pressure transducer 36.

Connector 34 has fluid passageway 76 that extends between pipe coupling 102 and transducer coupling 106 through connector head 100. Fluid passageway 76 allows fluid communication between pipe coupling 102 and transducer coupling 106 thereby allowing pressure reading from the interior of pipe section 32 to be obtained by pressure transducer 36, as depicted in FIG. 2.

Connector head 100 of connector 34 is a rectangular prism having dimensions c, d and e. Dimension, c, represents the length of connector head 100 extending coaxially from transducer coupling 106 and perpendicular to the axis of pipe coupling 102. Dimension, d, represents the length of connector head 100 extending coaxially from pipe coupling 102 and perpendicular to the axis of transducer coupling 106. Dimension, e, represents the length of connector head 100 extending perpendicular to transducer coupling 106 and perpendicular to pipe coupling 102.

Even though connector head 100 has been described as a rectangular prism, it should be understood by one skilled in the art that connector head 100 may be designed using other geometric shapes so long as the relative dimension characteristics of connected head 100 with respect to pipe section 32 are maintained. For example, connector head 100 may be designed having a cylindrical shape.

Figure 4:
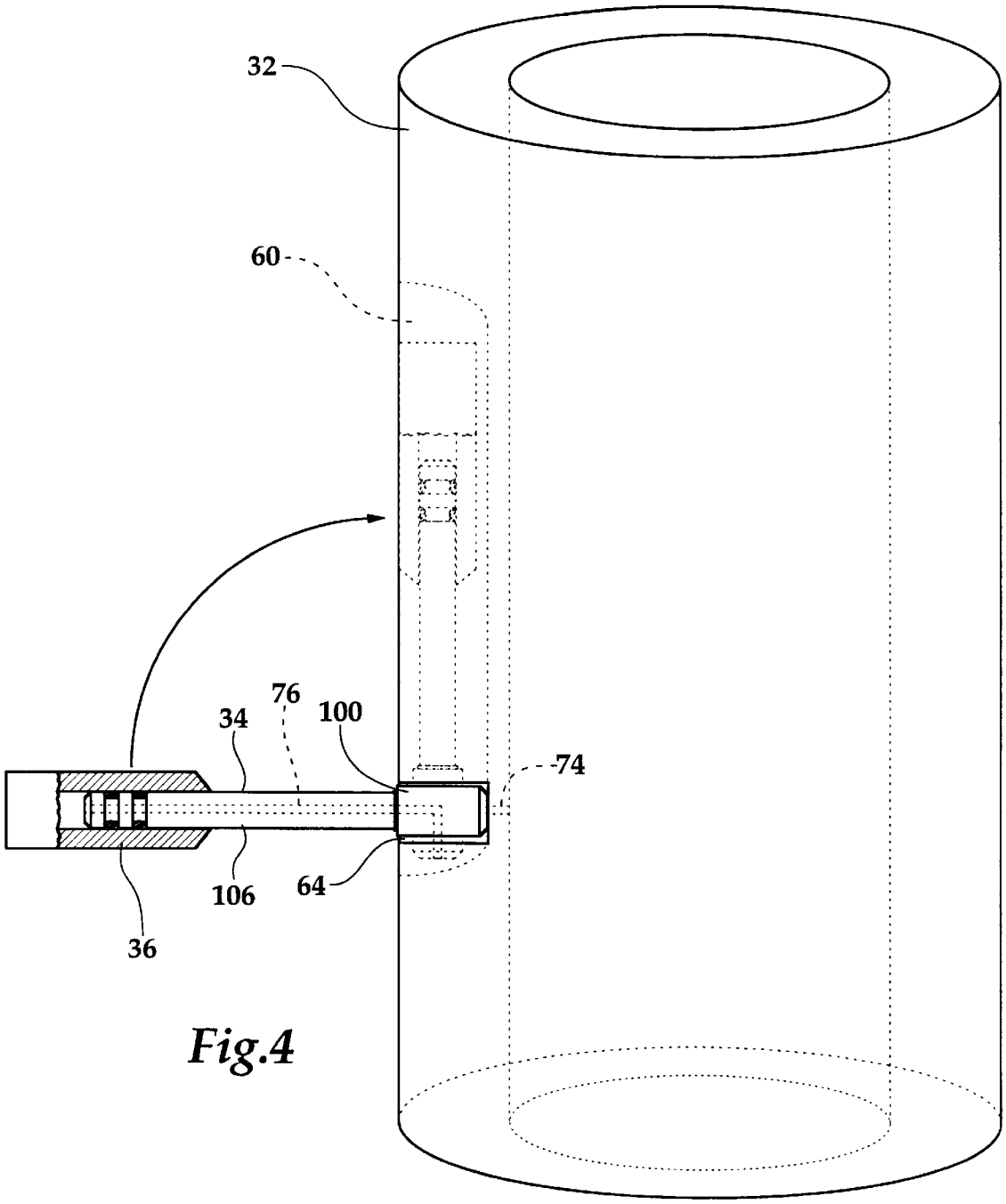
FIG. 4 is a perspective view of a connector of the present invention being locked onto a pipe section.

Referring to FIG. 4 and with reference to FIGS. 2 and 3A–3C, the installation procedure for connector 34 to pipe section 32 is depicted. Pressure transducer 36 is fitted over transducer coupling 106 of connector 34. Pressure transducer 36 may be any suitable pressure transducer that is well known in the art which can be mounted within wide longitudinal slot 60. To attach connector 34 to pipe section 32, pipe coupling 102 is coaxially aligned with hole 66 of pipe section 32, as best seen in FIG. 2. Connector 34 may then be rotated so that transducer coupling 106 is perpendicular to pipe section 32, as best seen in FIG. 4. Connector head 100 of connector 34 may then slide toward hole 66 through transverse slot 64. Width, b, of transverse slot 64 is greater than length, e, of connector head 100, allowing connector head 100 to be received therein and slide therethrough. Pipe coupling 102 is inserted into hole 66 of pipe section 32 until connector head 100 is aligned with narrow longitudinal slot 62 between sides 78, 80, as best seen in FIG. 2. In order to lock connector 34 in place, hydraulic connector 34 is rotated around the axis of pipe coupling 102. As connector 34 is rotated about the axis of pipe coupling 102, connector head 100 rotates within narrow longitudinal slot 62. The width, a, of longitudinal slot 62 is greater than length, d, of connector head 100 and is sized to closely receive connector head 100. Once connector 34 is rotated ninety degrees, connector 34 is locked within pipe section 32 between sides 78, 80 of narrow longitudinal slot 62. The fact that length, c, of connector head 100 is longer than width, b, of transverse slot 64 prevents pipe coupling 102 from sliding out of hole 66 and prevents connector 34 from sliding out of pipe section 32 once connector 34 is locked in place. Once connector 36 is locked in place, pressure reading from the interior of pipe section 32 may be obtained by pressure transducer 36 through port 74 and fluid passageway 76.

Figure 5C:
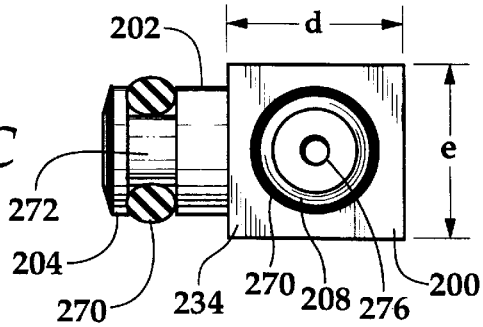
FIGS. 5A–5C are respectively side, front and top elevation views of another connector of the present invention.
Figure 5B:
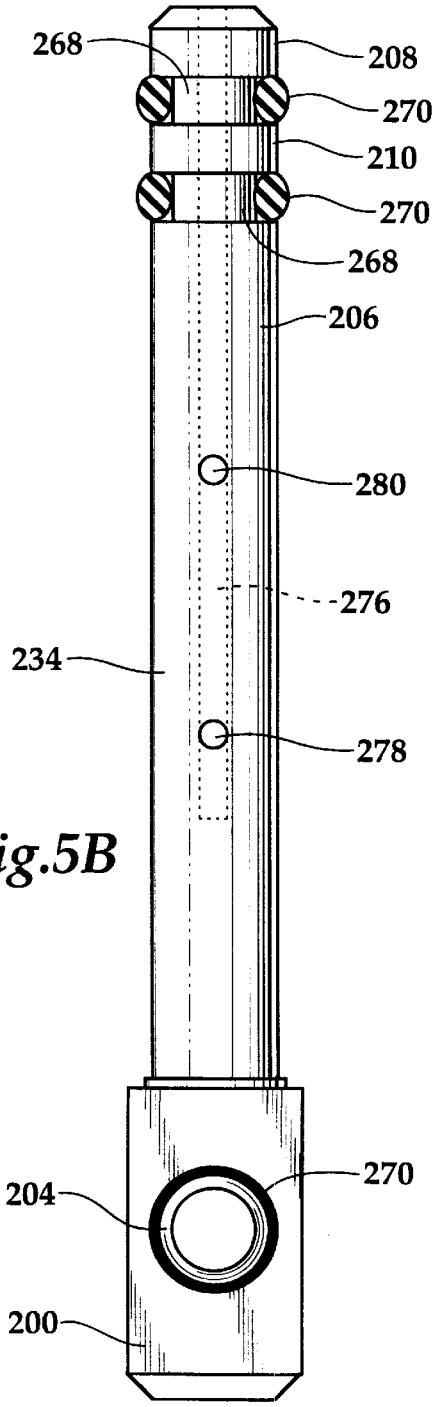
Figure 5A:
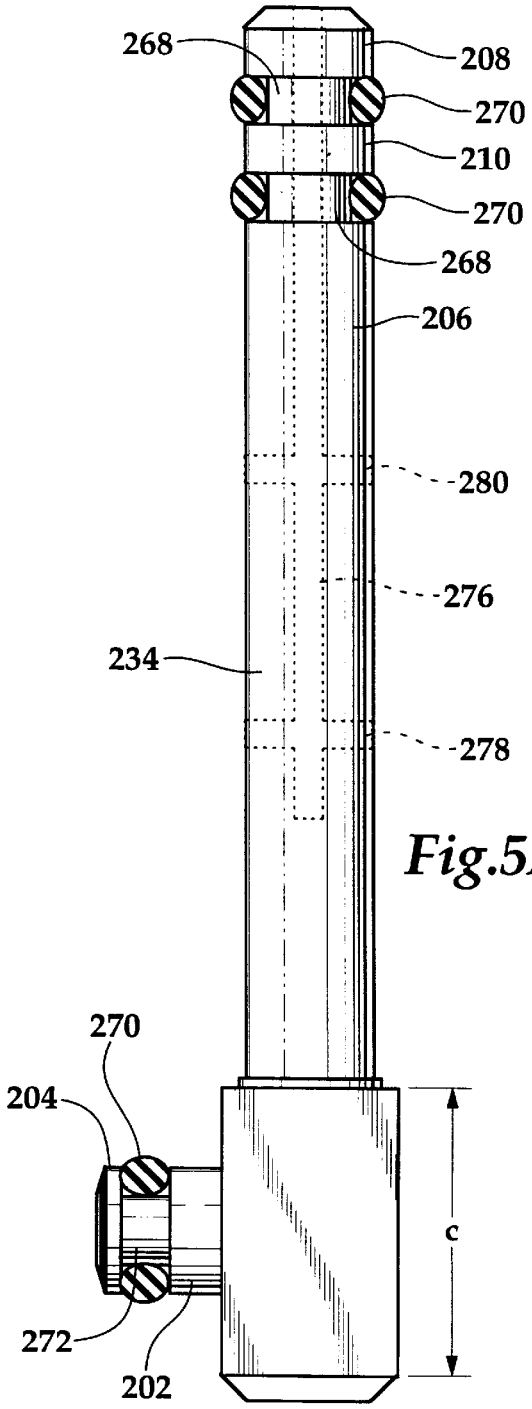

Now referring to FIGS. 5A–5C, another embodiment of connector 234 is depicted. Connector 234 has a connector head 200. Extending outwardly from connector head 200 is pipe coupling 202. Pipe coupling 202 has an outer flange 204 and a radially reduced area 272 for receiving and retaining an annular seal 270 such that when connector 234 is coupled with pipe section 32, as depicted in FIG. 2, a sealing engagement is created between pipe coupling 202 and hole 66 of pipe section 32. Extending outwardly from connector head 200 at a ninety degree angle from pipe coupling 202 is transducer coupling 206. Transducer coupling 206 has an outer flange 208, a separator flange 210 and a pair of radially reduced areas 268. Radially reduced areas 268 receive and retain annular seals 270. Separator flange 210 maintains a spaced apart relationship between the annular seals 270. Annular seals 270 create a sealing engagement between transducer coupling 206 and pressure transducer 36.

Connector 234 has fluid passageway 276 that extends through a portion of transducer coupling 206. Connector 234 also has a pair of ports 278, 280, that provide for fluid communication between the outside of connector 234 and fluid passage 276. Fluid passageway 276 allows fluid communication between ports 278, 280 and pressure transducer 36 thereby allowing pressure reading from the exterior of pipe section 232 to be obtained by pressure transducer 36.

Connector head 200 of connector 234 is a rectangular prism having dimensions c, d and e. Dimension, c, represents the length of connector head 200 extending coaxially from transducer coupling 206 and perpendicular to the axis of pipe coupling 202. Dimension, d, represents the length of connector head 200 extending coaxially from pipe coupling 202 and perpendicular to the axis of transducer coupling 206. Dimension, e, represents the length of connector head 200 extending perpendicular to transducer coupling 206 and perpendicular to pipe coupling 202. Connector 234 may be installed within pipe section 32 in the manner described above with reference to connector 34 in FIG. 4.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A connector apparatus comprising:

a connector head;

a first coupling extending from the connector head in a first direction; and a second coupling extending from the connector head in a second direction perpendicular to the first direction, the second coupling defining a fluid passageway and at least one port in the side thereof providing fluid communication between the fluid passageway and the outside of the second coupling, the connector head having a first dimension corresponding to the length of the connector head parallel to the second direction and a second dimension corresponding to the length of the connector head perpendicular to the first direction and perpendicular to the second direction, the first dimension being larger than the second dimension.

2. The apparatus as recited in claim 1 wherein the first coupling further comprises a flange and a radially reduced area.

3. The apparatus as recited in claim 2 further comprising an annular seal disposed about the radially reduced area.

4. The apparatus as recited in claim 1 wherein the second coupling further comprises a flange and a pair of radially reduced areas having a separator flange therebetween.

5. The apparatus as recited in claim 4 further comprising a pair of annular seals disposed respectively about the pair of radially reduced areas.

6. The apparatus as recited in claim 1 wherein the first coupling, the connector head and second coupling each define a fluid passageway, thereby providing for fluid communication therethrough.

7. A connector apparatus comprising:

a connector head;

a first coupling extending from the connector head in a first direction the first coupling including a flange and a radially reduced area; and a second coupling extending from the connector head in a second direction perpendicular to the first direction, the second coupling including a flange and a pair of radially reduced areas having a separator flange therebetween, the connector head having a first dimension corresponding to the length of the connector head parallel to the second direction and a second dimension corresponding to the length of the connector head perpendicular to the first direction and perpendicular to the second direction, the first dimension being larger than the second dimension.

8. The apparatus as recited in claim 7 further comprising an annular seal disposed about the radially reduced area of the first coupling.

9. The apparatus as recited in claim 7 further comprising a pair of annular seals disposed respectively about the pair of radially reduced areas of the second coupling.

10. The apparatus as recited in claim 7 wherein the first coupling, the connector head and second coupling each define a fluid passageway, thereby providing for fluid communication therethrough.

11. The apparatus as recited in claim 7 wherein the second coupling defines a fluid passageway and at least one port providing fluid communication between the fluid passageway and the outside of the second coupling.

12. A connector apparatus comprising:

a connector head defining a fluid passageway therethrough having a first end and a second end;

a first coupling extending from the connector head in a first direction, the first coupling including a flange and a radially reduced area, the first coupling defining a fluid passageway therethrough that is in communication with the first end of the fluid passageway of the connector head; and a second coupling extending from the connector head in a second direction perpendicular to the first direction, the second coupling including a flange and a pair of radially reduced areas having a separator flange therebetween, the second coupling defining a fluid passageway therethrough that is in communication with the second end of the fluid passageway of the connector head, the connector head having a first dimension corresponding to the length of the connector head parallel to the second direction and a second dimension corresponding to the length of the connector head perpendicular to the first direction and perpendicular to the second direction, the first dimension being larger than the second dimension.

13. The apparatus as recited in claim 12 further comprising an annular seal disposed about the radially reduced area of the first coupling.

14. The apparatus as recited in claim 12 further comprising a pair of annular seals disposed respectively about the pair of radially reduced areas of the second coupling.

15. The apparatus as recited in claim 12 wherein the second coupling defines at least one port providing fluid communication between the fluid passageway of the second coupling and the outside of the second coupling.

* * * * *